United States Patent [19]

Cobaugh et al.

[11] 4,039,239

[45] Aug. 2, 1977

[54] WIRE SLOT CLIP

[75] Inventors: Robert Franklin Cobaugh, Elizabethtown; James Edward Lynch, Harrisburg, both of Pa.

[73] Assignee: AMP Incorporated, Harrisburg, Pa.

[21] Appl. No.: 669,772

[22] Filed: Mar. 24, 1976

[51] Int. Cl.[2] ..... H01R 11/20

[52] U.S. Cl. ..... 339/97 R

[58] Field of Search ..... 339/97–99

[56] References Cited

U.S. PATENT DOCUMENTS

| | | | |
|---|---|---|---|
| 3,243,757 | 3/1966 | Cobaugh | 339/97 R |
| 3,617,983 | 11/1971 | Patton | 339/98 |
| 3,895,852 | 7/1975 | Masserlein, Jr. | 339/99 R |

*Primary Examiner*—Joseph H. McGlynn

*Attorney, Agent, or Firm*—AMP Incorporated

[57] ABSTRACT

A metal clip for connecting an insulated wire and a terminal post together without stripping the wire or solder. The clip is generally channel-shaped with a first slot means extending across the bottom wall of the channel and into the side walls of the channel. Extensions of the free end of the side walls are folded within the channel back towards the bottom wall and have second slots formed therein which are aligned with the first slot means. The conductor is inserted into the first and second slots and then the terminal post is pushed into the channel at right angles to the wire and adjacent the bottom wall thereof to force the conductor farther back into the slots and causing the edges of the slots to either grip or cut through the insulation and into the wire, thereby making a good electrical and mechanical connection.

5 Claims, 9 Drawing Figures

FIG. 3

FIG. 8
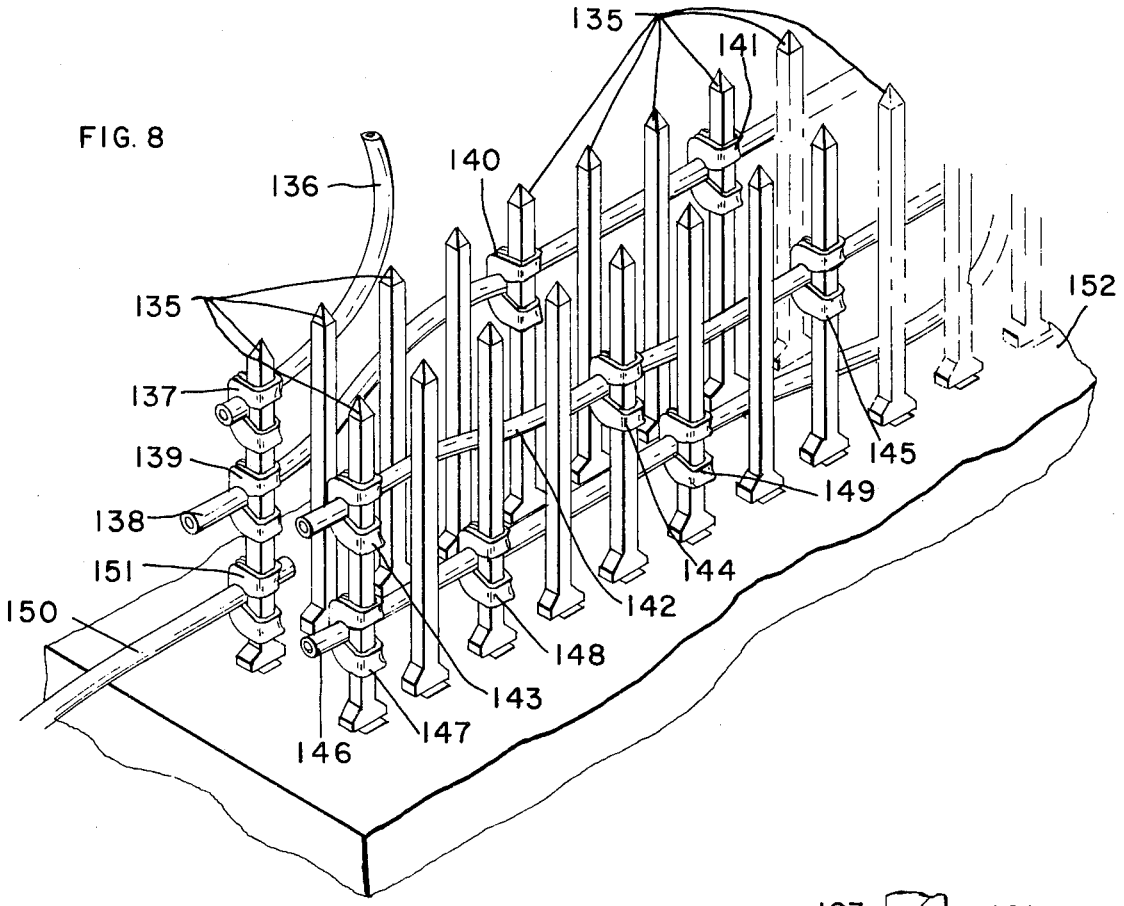
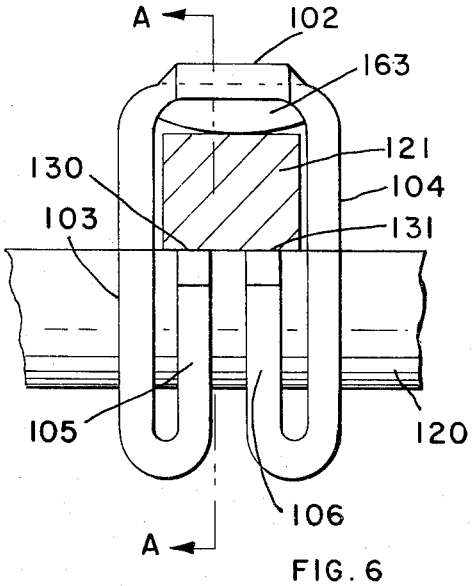
FIG. 6
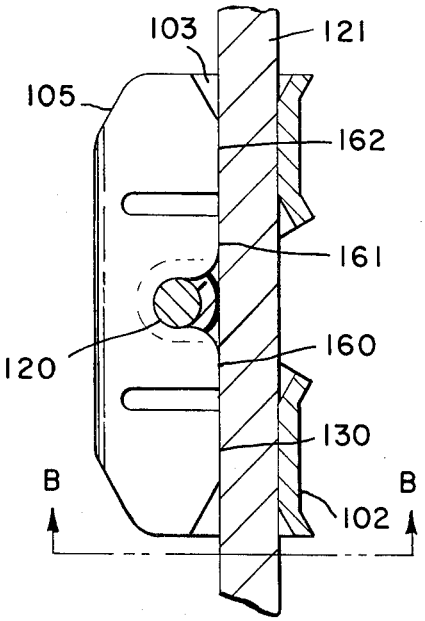
FIG. 7

WIRE SLOT CLIP

BACKGROUND OF THE INVENTION

This invention relates generally to a means for connecting wires to terminal posts and more specifically to a removeable spring clip which connects an insulated wire or a non-insulated wire to a terminal post without the use of solder.

There are several known ways of connecting wires to terminal posts. Two of the most common ways are wrapping the wire around the terminal post and employing a metal clip to attach the wire to a post. Ordinarily the wire is first soldered to the metal clip which is then pushed onto the terminal post. The clip is designed to exert a residual spring-like force against the post after being installed thereon to maintain good electrical and mechanical connection. The requirement that the wire be soldered to the clip presents some difficulties. One such difficulty is the extra manufacturing steps and accompanying cost soldering entails. Further, it is necessary to strip the wire prior to a soldering operation, and in those cases where a single wire is attached to more than two wire clips the wire must be stripped in the center thereof as well as at the ends.

BRIEF STATEMENT OF THE INVENTION

It is a primary object of the invention to provide a clip means for attaching a wire to a post without using solder.

It is a further purpose of the invention to provide a clip means which presses a terminal and an insulated wire together to force a portion of the clip through the insulation to make electrical and mechanical connection between the terminal post and the wire.

A third aim of the invention is a means for removably attaching an insulated wire to a terminal post without first stripping the insulation from the wire.

A fourth object of the invention is a means for electrically and mechanically attaching an insulated wire to a terminal post without first stripping the wire and without using solder.

A fifth purpose of the invention is a reliable and disconnectable wire to post termination without using solder.

A sixth aim of the invention is the improvement of means for connecting wires to terminal posts generally.

In accordance with one form of the invention a single sheet of metal is formed into a generally U-shaped channel with a first wire receiving slot means formed across the bottom of said channel and extending transversely up the side walls of the channel. The free edges of the channel walls have extensions connected thereto which are folded inwardly into the U shaped channel and back towards the bottom of the channel. Such folded back extensions have second slot means formed therein which are aligned with and are narrower than said first slot means and which bite through the wire insulation into the metal wire, whereas the first slot means has a width calculated to bite only into the wire insulation to provide a strain relief function. In the assembled form of the invention the wire is inserted into the first and second slot means in a direction substantially perpendicular to the direction of the channel, and the terminal post is then inserted into the channel along the bottom thereof and at right angles to the wire to press the wire into the first and second slot means with the first slot means acting as a strain relief slot and the second slot means biting through the insulation and into the metal wire.

In accordance with one feature of the invention the depth of the second slot means is just sufficient to enable the terminal post to push the wire firmly therein so that the edges around said second slot means will bite through the insulation and into the metal wire.

In accordance with another feature of the invention the folded back extensions of the channel side walls provide a residual spring effect to maintain a lasting force which presses the wire and the post together.

In accordance with a third feature of the invention third slot means are cut into the folded back extensions of the side walls on each side of the second slot means parallel and adjacent thereto, to provide a residual spring force effect upon the wire positioned within the second slot means.

BRIEF DESCRIPTION OF THE DRAWINGS

The above-mentioned and other objects and features of the invention will be more fully understood from the following detailed description thereof when read in conjunction with the drawings in which:

FIG. 6 is a sectional view of the assembly looking down the axis of the terminal post taken along the plane B—B of FIG. 7, and shows the relationship between the clip, the terminal post and the wire; and FIG. 7 is a sectional view of the assembly looking down the axis of the wire taken along the plane A—A of FIG. 6;

FIG. 8 is a perspective view of a number of clips and wires secured in various permutations to an array of terminal posts mounted in a substrate.

DETAILED DESCRIPTION OF THE OPERATION OF THE INVENTION

Figure 1:
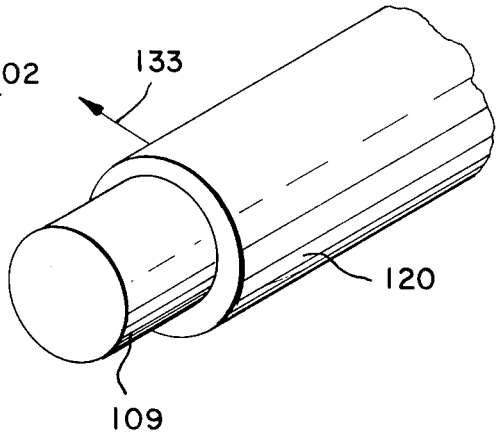
FIG. 1 is a perspective view of the wire clip of the invention with portions thereof broken away to show the construction of the folded back extensions of the channel wall.
Figure 2:
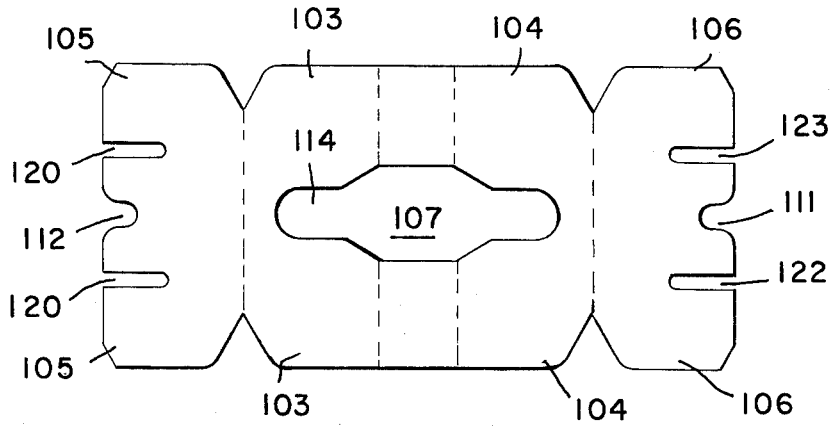
FIG. 2 shows the stamped blank form of the metal clip before any bending or folding has occurred.

Referring now to FIG. 1 there is shown a perspective view of the clip 100 which connects the wire 120 to the terminal post 121. The clip of FIG. 1 is formed from a flat piece of stock stamped in the shape shown in FIG. 2. The flat stamping of FIG. 2 is shaped into the generally channel-shaped configuration 100 of FIG. 1, with the bottom of the channel designated by reference characters 101 and 102 and the two main side walls of the channel by reference characters 103 and 104.

Elements 105 and 106 comprise extensions of the free edges of the two main side walls 103 and 104 and are folded back on the inner surfaces of said main side walls 103 and 104, as shown in FIG. 1.

A slot, identified generally by reference character 107 is cut into the bottom surfaces 101 and 102 of the channel and extend up into the side walls 103 and 104. The slot 107 narrows into slots 113 and 114 within side walls 103 and 104 to receive the wire, as shown in FIGS. 2, 3 and 4.

The folded back extensions 105 and 106 also have slots 111 and 112 formed therein which are substantially aligned with the slots 113 and 114 of side walls 103 and 104. However, slots 111 and 112 are slightly narrower and shallower than slots 113 and 114. Specifically, when the wire 120 is forced into slots 111 and 112 the edges thereof will cut through the insulation of wire 120 and will bite into the metal conductor thereof, as indicated in FIG. 7. The slots 113 and 114 are designed primarily to be strain relief slots and as such will bite into the insulation of the wire but not to any appreciable extent into the metal of the wire.

Figure 3:
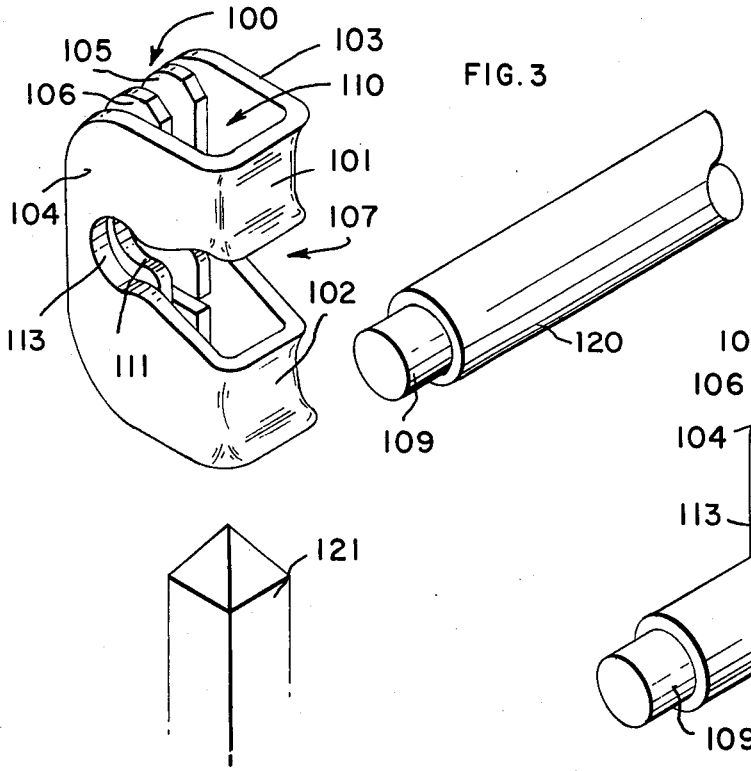
FIGS. 3, 4 and 5 show a three step progression of the installation of the wire into the clip and of the clip onto the terminal post.
Figure 4:
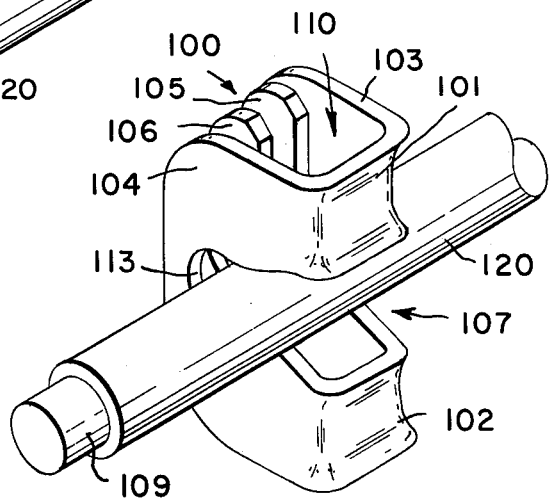

The post 121 is inserted into the opening 110 formed by the channel configuration of the clip 100, as shown in FIGS. 2, 3 and 4. The dimensions of the clip 100, the wire 121 and the terminal post 120 are such that the post 120 will force wire 121 into slots 111 and 112 of folded back portions 105 and 106 and also into the aligned slots 113 and 114, as indicated in FIGS. 2, 3 and 4.

Figure 5:
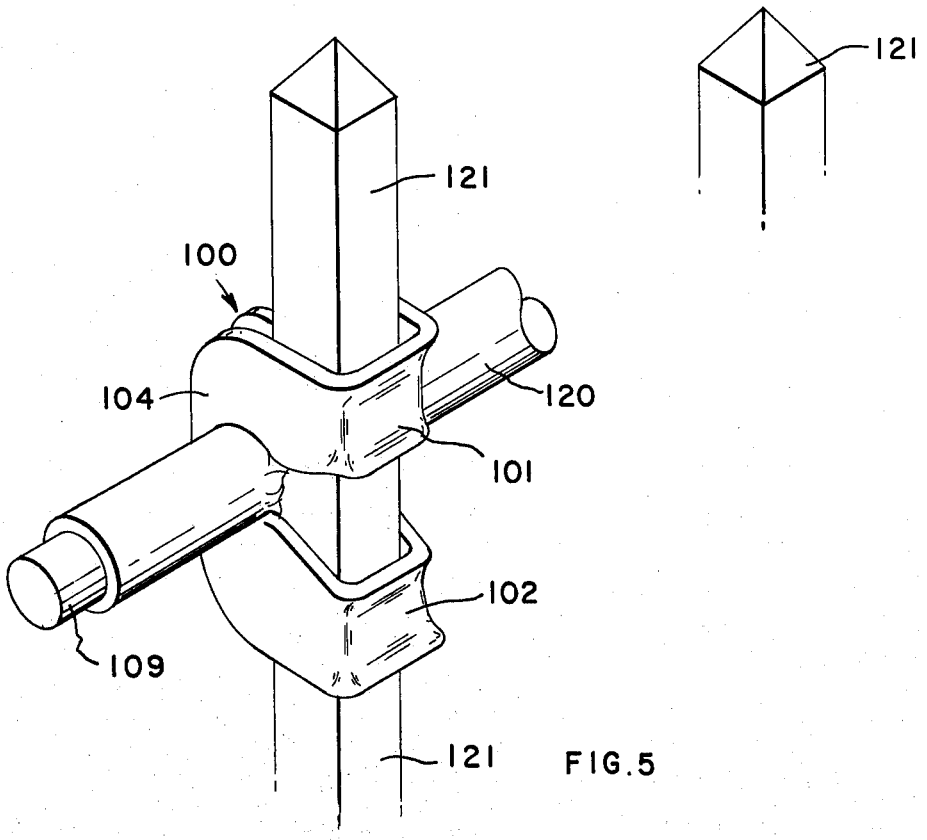

Reference is made to FIGS. 3, 4 and 5 which illustrate a three step operation of the assembly of the wire 120 and the terminal posts 121 into the channel-shaped clip 100.

Specifically, in FIG. 3 the terminal post 121, the wire 120 and the clip 100 are shown completely separated. In FIG. 4 the wire 120 has been inserted into the main slot 107 of clip 100 and has in fact been moved back into the smaller slots 113, 114 and 111, 112 formed in the side walls 103 and 104 and the folded back portions 105 and 106, but have not been pressed firmly therein by the post 121 which is shown in FIG. 4 as not yet being inserted.

In FIG. 5 the post 121 has been inserted through the channel 110 of clip 100 and in so doing has forced the conductor 120 well back into the slots 113 and 114 formed in the main side walls 103 and 104 of the clip 100 and also into the narrower slots 111 and 112 formed in the folded back portions 105 and 106 of clip 100.

In forcing conductor 120 back into slots 111 and 112 the edges of said slots 111 and 112 are forced to penetrate through the insulation of conductor 120 and into the metal wire 109 contained therein, thereby forming good electrical and mechanical connection therewith. The slots 113 and 114 of side walls 103 and 104 are caused to bite into the insulation of conductor 120 to provide a strain relief effect.

Reference is made to FIGS. 6 and 7 which show sectional views of the assembled clip 100, terminal post 121 and conductor 120. In FIG. 6 for example, which is a sectional view of the structure of FIG. 7 taken along the plane B—B, the post 121 can be seen to be pressed against the conductor 120 to force said conductor 120 into the slots of side walls 103 and 104 and the slots of folded back extensions 105 and 106 thereof.

In FIG. 7, which is a sectional view taken along the plane A—A of FIG. 6, an end view of conductor 120 and its relationship to terminal post 120 can be more clearly seen. The terminal post 121 is held against the inner surfaces of the bottom side wall portions 101 and 102 of clip 100 on one side and on the other side presses against the conductor 120 to force said conductor 120 into slot 112 of folded back portion 105 and also into the slot (not shown) of main side wall 103 of metal clip 100. In FIG. 7 it can be seen that conductor 120 is forced well into the rear of the aforementioned slots.

The edges 130, 160, 161 and 162 of FIG. 7 preferably abut against the post 121 with a spring force to make good electrical and mechanical connection therewith. Such edges 130, 160, 161 and 162 can be serrated or otherwise irregularly shaped to further insure good contacts with terminal post 121.

As shown in FIG. 6 one or more dimples 163 or equivalent embossment or lance can be formed in the channel bottom 102 to provide further spring force upon post 121.

Figure 9:
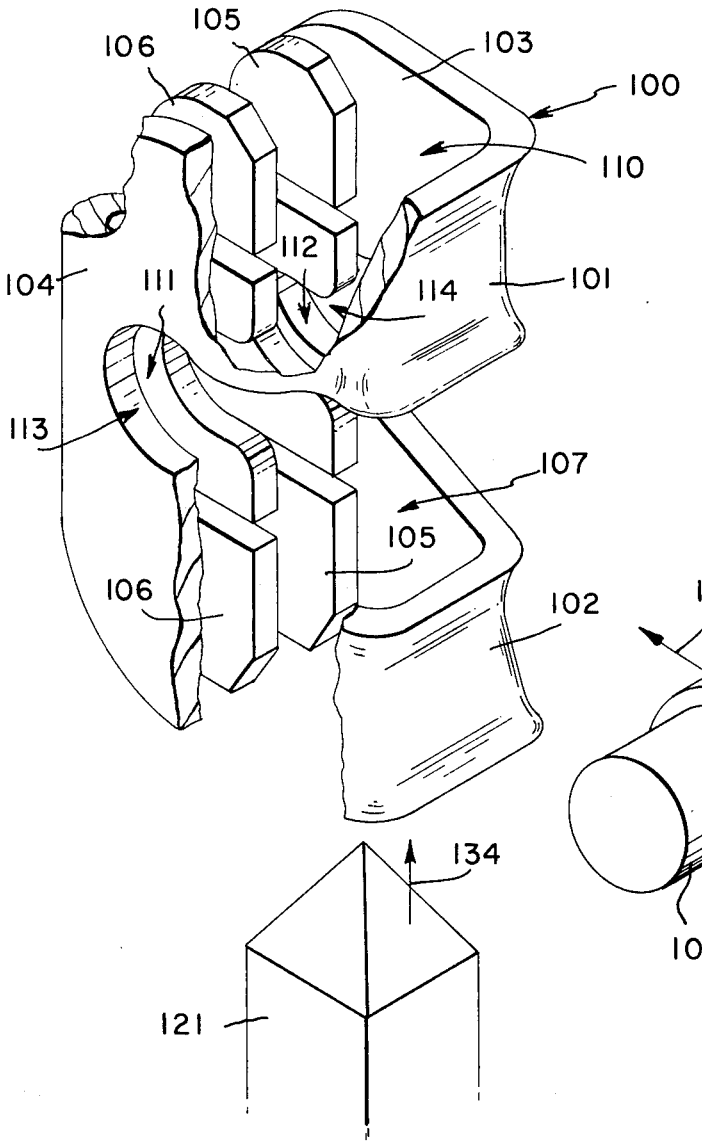
FIG. 9 is a view of another form of the invention.
Figure 9:
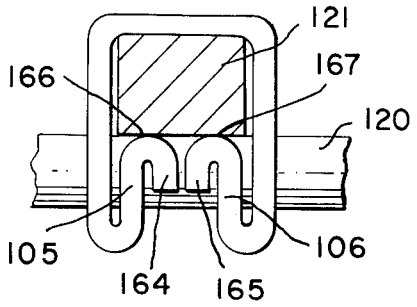

In FIG. 9 there is shown another form of the clip in which the bent-back portions 105 and 106 themselves have further folded-back portions 164 and 165, with wire 120 receiving slots formed therein. The edges 166 and 167 are positioned to exert a spring-like force against the terminal post 121.

Referring now to FIG. 8 a plurality of terminal posts 135 are shown mounted in a common substrate 152. The terminal posts 135 are connected together in various combinations and manners by conductors 136, 138, 142, 146 and 150 and the metal connecting clips of the invention. For example, conductor 136 is connected at one end only to a post 135 by metal clip 137. As another example, the conductor 138 is connected to various ones of the posts 135 by means of clips 139, 140 and 141. Similarly, the conductor 142 is connected to selected ones of terminal posts 135 by metal clips 143, 144 and 145. A fifth connector 150 is connected at one end only to a terminal post by means of metal clip 151. It is evident from the various permutations of connections between the metal clips and the array of terminal posts that the connections between conductors and terminal posts can be quite varied. A single conductor, for example, can be a common bus bar for a multiplicity of terminal posts, including for example, all of the terminal posts in a given row of posts or only selected ones thereof.

Furthermore, it is evident from the structure of FIG. 8 that a plurality of conductors can be connected to the same terminal post. As for example, the conductors 136, 138 and 150 are all connected to the same terminal post by means of clips 137, 139 and 151 respectively. Any of these metal clips and the conductors contained therein can be removed from any given terminal post and replaced with another clip and conductor, as desired. For example, if it is desired to remove the conductor 138 and the clip 139 from the terminal post to which it is connected, the top clip 137 containing conductor 136 would first be removed and then the clip 139 and its contained conductor 138 subsequently removed. The clip 137 and its contained conductor 136 could then be replaced upon the post.

It is to be understood that the forms of the invention shown and described herein are but preferred forms thereof and that various changes can be made in the detailed design of the clip and in the proportionate dimensions thereof without departing from the spirit or scope of the invention.

What is claimed is:

1. A clip means for connecting an insulated wire to a terminal post and comprising:

a generally channel-shaped conductive body having a bottom wall and first and second side walls attached at first edges thereof to opposite edges of said bottom wall and perpendicular thereto;

a first slot means extending transversely across said bottom wall and into the said first and second side walls, with the portion of said slot means extending into said side walls narrowing to a width less than the outside diameter of said insulated wire;

first and second extensions attached to second edges of said first and second side walls, respectively, and folded back towards the bottom wall within the channel-shaped conductive body and terminating a given distance from said bottom wall;

second and third slot means formed in said first and second extensions and aligned with a portion of the first slot means extending into said first and second side walls with a portion thereof having a width less than the diameter of said wire.

2. A clip means for connecting an insulated wire to a terminal post and comprising:

a generally channel-shaped conductive body comprising a bottom wall and first and second side walls attached perpendicularly to opposite edges of said bottom wall perpendicularly thereto and constructed to retain the terminal post therein adjacent said bottom wall and said side walls;

first slot means extending transversely across said bottom wall and into the said first and second side walls, with the portion of said slot means extending into said side walls narrowing to a first width less than the diameter of said insulated wire;

at least one extension connected to the unattached edge of one of said first and second side walls and folded back towards said bottom wall within the channel-shaped conductive body and terminating a given distance from said bottom wall;

second slot means formed in said at least one extension and aligned with a portion of the first slot means extending into said first and second side walls with the portion of said aligned second slot means having a width less than the diameter of said wire and constructed to receive said wire therein;

said given distance being less than the thickness of said terminal post measured normal to said bottom wall.

3. A clip means for connecting an insulated wire to a terminal post and comprising:

a generally channel-shaped conductive body having a bottom wall and a first and second side walls having first edges thereof attached to opposite edges of said bottom wall and perpendicular thereto;

a first slot means extending transversely across said bottom wall and into the said first and second side walls a first given distance, with the portion of said slot means extending into said side walls having a width less than the outside diameter of said insulated wire and constructed to receive said insulated wire therein;

first and second extensions attached to second edges of said first and second wide walls, respectively, and folded back towards the bottom wall within the channel-shaped conductive body and terminating a second given distance from said bottom wall;

second and third slot means formed in said first and second extensions and aligned with a portion of the first slot means extending into said first and second side walls with a portion thereof having a width sufficient to receive said insulated wire therein;

said channel-shaped conductive body constructed to receive said terminal post therewithin axially along its length and within an opening defined by said bottom wall, said side walls and said insulated wire and being dimensioned to force said insulated wire into said first, second and third slot means.

4. In combination, a terminal post, an insulated wire, and a clip means for connecting said insulated wire to said terminal post and comprising:

a generally channel-shaped conductive body comprising a bottom wall with first and second side walls having first edges attached perpendicularly to opposite edges of said bottom wall and constructed to retain said terminal post therein adjacent said bottom wall and said side walls;

first slot means extending transversely across said bottom wall and into the said first and second side walls, with a given portion of said first slot means extending into said side walls having a width less than the diameter of said insulated wire;

at least one extension connected to the unattached edge of one of said first or second side walls and folded back towards said bottom wall within the channel-shaped conductive body and terminating a given distance from said bottom wall;

second slot means formed in said at least one extension and aligned with said given portion of the first slot means, and with a portion of said aligned second slot means having a width less than the diameter of said wire and constructed to receive and retain said wire therein;

said given distance being less than the thickness of said terminal post measured normal to said bottom wall;

said wire being positioned within said first and second slot means in a direction transverse to said channel; and said terminal post being positioned longitudinally in said channel-shaped body perpendicularly to and bearing against, said insulated wire, to force said insulated wire into the narrow portions of said first and second slot means.

5. In combination, a terminal post, an insulated wire, and a clip means for connecting said insulated wire to said terminal post and comprising:

a generally channel-shaped conductive body having a bottom wall and first and second side walls attached at first edges thereof to opposite edges of said bottom wall and perpendicular thereto;

a first slot means extending transversely across said bottom wall and into the said first and second side walls, with the portion of said slot means extending into said side walls narrowing to a width less than the outside diameter of said insulated wire;

first and second extensions attached to second edges of said first and second side walls, respectively, and folded back towards the bottom wall within the channel-shaped conductive body and terminating a given distance from said bottom wall;

second and third slot means formed in said first and second extensions and aligned with a portion of the first slot means and extending into said first and second side walls with a portion thereof having a width less than the diameter of said wire;

said wire being positioned within said first and second slot means in a direction transverse to said channel; and said terminal post being positioned longitudinally in said channel-shaped body perpendicularly to and bearing against, said insulated wire, to force said insulated wire into the narrow portions of said first and second slot means.

* * * * *